United States Patent [19]

Davies et al.

[11] 4,356,099

[45] Oct. 26, 1982

[54] FABRIC TREATMENT PRODUCTS

[75] Inventors: James F. Davies, Wirral; John B. Tune, Higher Bebington, both of England

[73] Assignee: Lever Brothers Company, New York, N.Y.

[21] Appl. No.: 262,845

[22] Filed: May 12, 1981

[30] Foreign Application Priority Data

May 16, 1980 [GB] United Kingdom ..... 8016243

[51] Int. Cl.[3] ..... D06M 13/00; D06M 13/16; B65D 33/16; C11D 17/00

[52] U.S. Cl. ..... 252/90; 229/62; 252/93; 252/174

[58] Field of Search ..... 252/90, 93, 174; 430/208; 222/541; 229/62

[56] References Cited

U.S. PATENT DOCUMENTS

| | | | |
|---|---|---|---|
| 4,110,498 | 8/1978 | Benjamin et al. | 428/35 |
| 4,142,978 | 3/1979 | Murphy | 252/8.7 |
| 4,234,442 | 11/1980 | Cornelissens | 252/92 X |
| 4,259,373 | 3/1981 | Demessemaekers et al. | 252/90 X |
| 4,286,016 | 8/1981 | Dimond | 252/99 X |
| 4,289,815 | 9/1981 | Lee | 252/90 X |

FOREIGN PATENT DOCUMENTS

| | | |
|---|---|---|
| 950256 | 2/1964 | United Kingdom . |
| 11500 | 11/1979 | United Kingdom . |
| 1583082 | 1/1981 | United Kingdom . |

*Primary Examiner*—Michael R. Lusignan

[57] ABSTRACT

A fabric treatment product for use in washing machines consists of a bag formed of water-insoluble, water-impermeable synthetic plastics sheet material containing a fabric treatment composition comprising a liquid, the bag having a weak seal that will be opened by the mechanical action of a washing machine.

3 Claims, 2 Drawing Figures

FABRIC TREATMENT PRODUCTS

Figure 1:
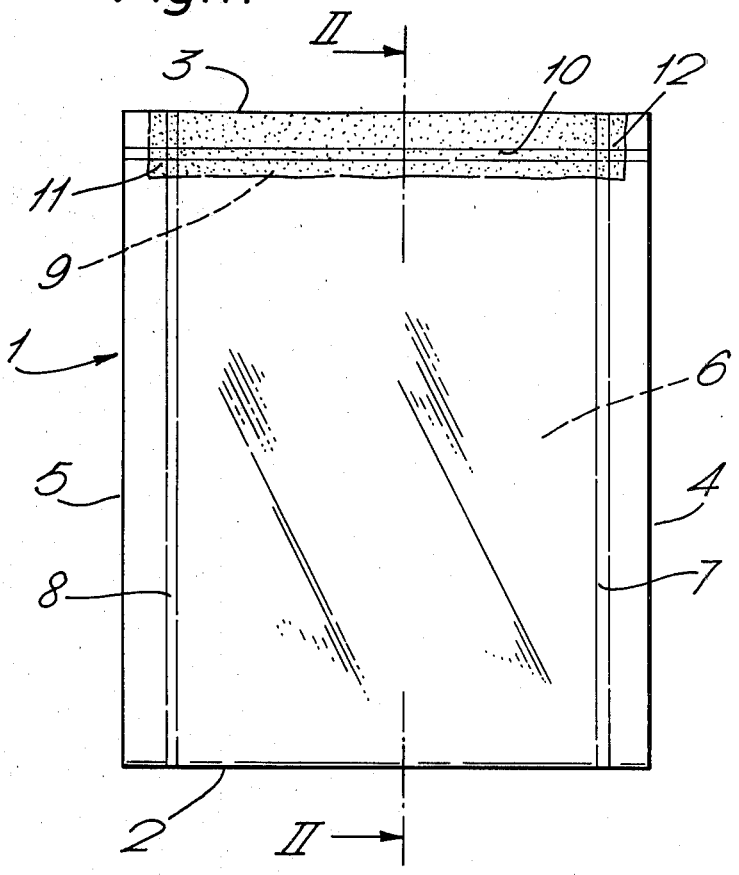

This invention relates to products which are suitable for treating fabrics, for example cleaning or conditioning them, in a washing machine and which contain treatment materials, such as fabric washing compositions, in liquid form.

Although the marketing of liquid detergent compositions packaged in bulk is common practice, this imposes constraints both on their formulation and methods of production. For example the compositions must be pourable and have an attractive appearance to the consumer, and the ingredients should not segregate during transport and storage. The compositions must also be safe, both for contact with the skin and in the event of accidental ingestion; in particular, the compositions should not contain too high a level of alkaline material, although alkalinity is beneficial for detergent efficiency. When using washing machines which have a rotating drum, there can also be substantial losses of conventionally dosed detergent compositions by retention in the dispenser and by its accumulation in the dead spaces beneath the drum, especially the drain hose.

In our British Pat. No. 1,583,082 there are described fabric treatment products which comprise particulate detergent compositions contained within a closed water-insoluble fibrous material bag which has a water-sensitive seal, whereby the contents of the bag are discharged on contact of the bag with water. These products give consumer benefits both by way of improved efficiency in the use of the detergent compositions and in greater convenience of use.

We have now discovered that improved products containing liquid fabric treatment compositions can be obtained using a synthetic plastics sheet material.

According to the invention there is provided a fabric treatment product in the form of a bag of water-insoluble, water-impermeable synthetic plastics material containing a fabric treatment composition comprising a liquid, the bag being closed by at least one weak seal so constructed as to be opened by mechanical action when in use in a washing machine.

The bag is preferably rectangular and formed either from two rectangular sheets of bag material sealed together at their four edges or from a single rectangular sheet of bag material folded over and sealed along three edges.

The synthetic plastics sheet material may be formed from a thermoplastic material and in this case is advantageously selected from sheets of polyolefins such as polyethylene, polypropylene, polystyrene; polyesters especially polyethylene terephthalate; vinyl polymers such as insoluble polyvinyl acetate and polyvinyl acrylate, polyvinyl chloride, and polyvinylidene chloride; polyamides and polyacrylonitrile; and other synthetic plastics sheet materials having similar physical properties. The sheet material will usually be in the form of a non-rigid film. However, it is also possible to form one wall of the bag with a rigid plastics sheet material, moulded into a suitable shape.

The liquid composition in the bag may, for example, be an aqueous or non-aqueous liquid detergent composition. Suitable non-reactive non-aqueous liquid bases include nonionic surfactants and others which may, for example, be selected from "Solvents Guide" by C Marsden, 2nd Edition, 1963, Cleaver-Hume Press Limited.

As used herein, the term "liquid" is intended to include pastes, creams, dispersions and slurries.

For use in fabric washing, the bag may, for example, contain a fully formulated detergent composition, that is, a composition containing at least a detergent-active material and a detergency builder. Alternatively, the bag may contain any one or more of the following fabric treatment materials: bleaches such as sodium perborate; bleach precursors such as tetraacetylethylene diamine (TAED); fabric softeners such as quaternary ammonium compounds; starch; perfumes; antibacterial agents; antistatic agents; whitening or blueing agents; enzymes; stain-removing agents and the like. It can be of particular advantage to add fabric treatment materials to the wash in a bag while dosing a fully formulated detergent composition in a conventional manner, where the incorporation of the fabric treatment material in the fully formulated detergent composition may otherwise be difficult. This is of particular importance in the case of perfumes, bleaches, bleach precursors and cationic fabric softening agents.

Examples of fully-formulated liquid fabric washing compositions which can be packaged to advantage in the products of the invention are amply described in the literature, for example, in "Surface Active Agents and Detergents", Volumes I and II, by Schwartz, Perry and Berch. However, the products of the invention offer especial advantages when used for liquid detergent products containing insoluble ingredients in suspension. Specific examples of such ingredients include finely divided calcium carbonate, the use of which is described, for example, in British Pat. No. 1,437,950, and sodium aluminosilicate ion exchange materials, as described, for example, in British Pat. Nos. 1,429,143, 1,473,201 and 1,473,202; sodium tripolyphosphate and sodium orthophosphate, as described, for example, in British Pat. No. 1,577,120; and sodium pyrophosphate, as described, for example, in U.S. Pat. Nos. 2,994,665 and 3,156,655. When heterogeneous liquid compositions of this type are packaged in bulk, the liquid ingredients must be selected so as to hold the insoluble ingredient in suspension, so that throughout the life of the bulk container each dose used contains the correct proportion of insoluble ingredient. Unit packaging in sachets according to the invention reduces the need for a suspending system having long-term stability, since the correct dose is automatically provided.

The bags can be formed, for example, from a single folded sheet formed into a tubular section, or from two sheets of material bonded together at the edges. For example, the bags can be sachets formed from single folded sheets and sealed on three sides or from two sheets sealed on four sides for the preferred rectangular shape. Alternatively, the sheets can be folded like envelopes with overlapping flaps to be sealed. Other bag shapes or constructions, for example, circular cushion-shaped sachets or sachets of tetrahedral form, may be used if desired. The bags may also be reinforced, if desired, to decrease the risk of leakage during handling, for example, by adding an extra thickness of the sheet material where the bags are expected to be held or passing completely round the bags to help support the weight of the liquid contents.

In use, the bag is placed in the washing machine together with a laundry load and water is run into the machine. In order to ensure that the bag will open in a washing machine to discharge its contents into the water in the machine, it is essential that the bag includes at least one opening seal which will open under mechanical action in the washing machine.

The time taken for the bag to open in use depends primarily on the strength of the opening seal, and also on a number of other factors such as, for example, the quantity of liquid composition contained in the bag, the weight and nature of the load which is placed with the bag into the washing machine, and the functional characteristics of the washing machine. Preferred fabric treatment products of the invention will open within 5 minutes, more preferably within 2 minutes of the start of the washing process when placed in a front loading automatic fabric washing machine such as the Hoover Electronic 1100 on any of its cycles, together with a load consisting of between 1 and 4 kg of terry towelling and/or cotton sheeting. The products of the invention are of course applicable to both front-loading and top-loading automatic washing machines and also to non-automatic washing machines.

The opening seal of the bag of the product of the invention may be formed by a variety of methods. According to one preferred embodiment of the invention, the bag is of thermoplastic material and the opening seal is a mechanically weak heat seal.

An especially preferred method of forming such a weak heat seal is to insert between opposed bag walls of thermoplastic film material a separator of porous sheet material, so that a bond is created by heat-sealing between each sheet of thermoplastic film and the fibrous material rather than directly between the two sheets of thermoplastic material. The separator is of material that is either non-thermoplastic, or, if thermoplastic, that flows only at a considerably higher temperature than that used for the heat-sealing operation. During heat-sealing, the thermoplastic material flows into the pores of the separator material and solidifies there, thus creating a weak bond. Direct bonding between the two bag walls is desirably avoided as far as possible.

The separator sheet is advantageously of fibrous material. Preferred materials include wet-strength papers, for example creped papers impregnated with cationic polymer, and nonwoven fabrics consisting of natural or synthetic fibres. If desired, the separator and one wall of the bag may be a pre-formed laminate.

As an alternative to heat-sealing, adhesive may be used to form a weak seal, steps being taken to ensure that a bond sufficiently weak to be susceptible to washing machine action is obtained. The adhesive may be self-sealing (contact seal), heat-sensitive or pressure-sensitive. Where the adhesive is a cold pressure sealable material, the weak seal may be formed by cold pressure sealing at a suitable sealing pressure. The adhesive may be applied from an aqueous or non-aqueous medium.

It may be necessary to treat the bag material to accept the adhesive, for example, by surface oxidation (corona discharge).

Advantageously, the film material of the bag may be of laminated structure, for example a cellulose film laminated on both faces with a relatively thin layer of polyvinylidene chloride film. One of the outer layers of the laminate may carry a cold contact or pressure sealant. The use of a laminate structure, such as this, enables one to achieve the desired strength, for example with an inner cellulose layer, while reducing the weight of the more costly synthetic material such as polyvinylidene chloride. Suitable such laminated films include Dioseal (Trade Mark) C, Dioseal (Trade Mark) P (a similar material with oriented polypropylene film in place of the cellulose film) and Dioseal (Trade Mark) PET, which comprises a polyester film coated with a cold contact seal adhesive or Trespaphan (Trade Mark) SND, a biaxially oriented polypropylene coated on both sides with low density polyethylene with a further layer of cold seal adhesive on one side. All these films are available from Transparent Paper Limited, Bury, Lancashire, England.

As a further alternative, the weak seal may be a purely mechanical seal. Thus, a mechanical seal of the "Minigrip" type formed by interlocking profiles provided near the edge of the faces to be sealed can be weakened by modifying the geometry of the sealing profiles, at least at one point along their length.

It is only essential that one seal of the bag should be an opening seal. However, it may be convenient to form all seals of the bag in the same manner.

It is of course essential that the opening seal or seals should not be such that the bag will open in transit or during handling.

The bags of the present invention may consist of a single compartment. However, in alternative embodiments of the invention the bag may include at least one further external wall defining one or more further compartments. This further wall may be formed of a similar material to the main walls of the bag, in which case the second compartment will also need an opening seal; alternatively, the further wall may be formed of a water-soluble film material, for example, polyvinyl acetate/polyvinyl alcohol, or a water-permeable water-insoluble material, for example, a fibrous sheet material. In this case, the further compartment will contain a particulate composition. Where said further wall is formed of a fibrous sheet material, this material should be sufficiently porous that, in use, water can enter the bag to assist in the dispersion of the particulate composition material in the washing machine liquor. It should not have a pore size so high that dusting of the particulate composition from the bag occurs to an unacceptable extent.

A suitable fibrous sheet material for forming the further wall of the bag is water-permeable paper or woven, knitted or especially non-woven fabric of high wet strength, weighing about 5 to 100 g/m$^2$, preferably 10 to 60 g/m$^2$, such as is commonly used for packaging beverage powders and other foodstuffs, and suitable sheet materials of this type are commercially available, for example wet strength paper from J R Crompton Brothers Limited of Bury, Lancashire, England.

The fibres preferably used for the sheet materials may be of natural or synthetic origin and may be used alone or in admixture, for example polyamide, polyester, polyacrylic, cellulose acetate, polyethylene, polypropylene, polyvinyl chloride, polyvinylidene chloride or cellulosic fibres. If some cellulose pulp fibres are used, it may be desirable to include a proportion of long fibres such as Manila hemp, in order to improve the strength of the sheet material, impart pliability, and reduce stiffness, thereby giving the material a fabric-like appearance/texture. A binder may also be necessary for increasing wet strength. It is preferred to include at least a proportion of thermoplastic fibres, for increasing resistance to chemical attack by any of the ingredients of the liquid treatment composition.

In the case where one wall of the bag is formed of fibrous sheet material, and a particulate treatment composition is present, the particle size distribution of the particulate material is preferably selected in relation to the pore size distribution of the fibrous material so that no more than about 5% by weight, preferably no more than about 1% of the particles can pass through the fibrous sheet material in the dry state, and hence causing dusting. Bags for very fine powders, for example made by dry mixing, should preferably be made from fibrous sheet material having a very small maximum pore size so as to allow only particles less than about 20 microns to dust from the bag on handling or in transit. Bags for coarser grained powders should preferably have one wall made from sheet material having a maximum pore size so as to allow only particles less than about 100 microns to dust from the bag.

In other embodiments of the invention the bag may contain at least one further wall positioned between the film material walls of the bag to divide it into two or more compartments. The further wall must of course be formed of a material impermeable to, and insoluble in, water. It is preferably formed of a similar material to the main walls of the bag. The further wall should be sealed at the edges to the remaining walls, for example by a mechanical seal, by heat-sealing or by cold pressure or contact sealing; and it is necessary that the further wall be sealed to the other walls of the bag by an opening seal, so as to enable the contents of the further compartment to be discharged in use.

It can be of particular advantage to use a bag according to the invention with more than one compartment for fabric treatment compositions which include incompatible components or where it is of advantage to delay the discharge of one particular component into the washing machine liquor. Thus, in the first case, a bag with two compartments may be filled with a liquid detergent composition containing enzymes in the first compartment and a bleach which is incompatible with the enzyme in the second compartment. In the second case a second compartment having a water-soluble or water-permeable wall and no opening seals may be filled with a particulate detergent composition including a per-salt, while the first compartment contains a liquid based chlorine bleach. The porosity of the water-permeable wall can be such that the particulate detergent composition is not released until any catalase in the wash liquor or on the load has been destroyed by the chlorine bleach.

If desired, the sheet material used to form the bag can be marked or tagged so that it can be easily recognised amongst the washed fabrics, for example the material may be printed with a simulated fabric pattern such as check or gingham.

Figure 2:
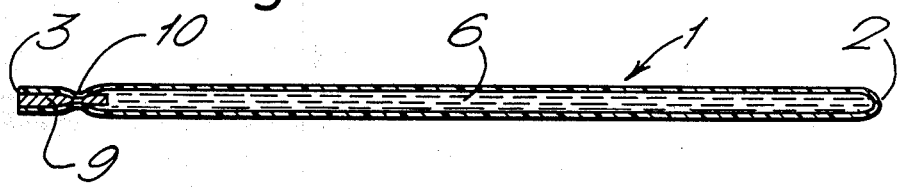

The invention will now be illustrated in more detail, by way of example only, with reference to the accompanying drawings, in which FIG. 1 represents a schematic plan view of a product according to the invention, and FIG. 2 represents a section, on a larger scale, along the line II—II of FIG. 1.

Referring now to FIGS. 1 and 2 of the accompanying drawings, a flat rectangular bag 1, approximately 9 cm×11 cm, is formed from a single sheet of polyethylene film folded once along a fold line 2 which forms one edge of the bag, the three remaining edges 3, 4, 5 being closed by heat-sealing. The bag contains a liquid detergent product 6. Each of the edges 4 and 5 adjacent to the fold line 2 is closed by a heat seal along a narrow band 7 or 8 parallel to, and spaced a short distance from, each edge. These are strong seals that will not open under washing machine conditions.

The fourth edge 3 is closed by a weak, opening seal. An elongate strip 9 of nonwoven fabric (40% cotton linters, 55% viscose, 5% polyamide) is positioned between the bag walls adjacent to the edge 3. The bag walls are heat-sealed to the strip 9 between them along a narrow band 10. The length of the strip 9 is such that it is longer than the distance between the two heat seals 7 and 8 for the edges 4 and 5, and at its end regions 11, 12 the strip 9 is also heat-sealed by means of the heat seals 7 and 8 to ensure that no leakage of contents can occur around the ends of the strip 9.

In use in a washing machine, the bag will open at the weak heat-seal 10 to release its contents 6, either by separation of the strip 9 from one bag wall or by splitting (delamination) of the strip 9 itself.

The invention will now be further illustrated by the following non-limiting Examples.

EXAMPLE 1

A bag was formed from a laminated material (Bemrose UK Ltd) having an inner layer of cellulose coated on each face with polyvinylidine chloride and with one of the outer faces having a coating of conventional cold sealant. The bag was formed by folding a sheet of material 22 cm×11 cm crosswise with the cold sealant innermost and sealing the two opposite edges to produce an open bag 11 cm×11 cm. The bag was filled with 100 g of a liquid detergent composition having the following composition, by weight:

| | % |
|---|---|
| Potassium dodecylbenzene sulphonate | 10.0 |
| Tetrapotassium pyrophosphate | 19.1 |
| Sodium xylene sulphonate (commercial) | 8.15 |
| Lauric diethanolamide | 3.8 |
| Lauric isopropanolamide | 3.2 |
| Sodium silicate (37%) ($Na_2O:SiO_2$ of 1:2.5) | 7.0 |
| Optical brighteners | 0.079 |
| Water plus KOH to pH 12.1 | 48.171 |
| Sodium carboxymethyl cellulose | 0.04 |
| Methyl cellulose | 0.46 |
| | 100.00 |

The final seal of the bag was then closed, using a pressure which would ensure that the bag would open, in use, in a washing machine.

The filled bag was then placed into a Hoover Electronic 1100 front-loading automatic washing machine together with a 7 lb soiled fabric load together with detergency monitors. The 40° C. wash cycle was selected.

It was found that the bag opened in less than two minutes from the beginning of the wash cycle and good detergency results were obtained.

EXAMPLE 2

The procedure of Example 1 was repeated using a liquid detergent composition having the following composition:

| | % |
|---|---|
| Dodecylphenol 10 mole ethylene oxide condensate | 7.0 |
| Polyoxyalkylene alkanol | 2.0 |
| Potassium pyrophosphate | 25.0 |
| Vinyl methyl ether and maleic anhydride interpolymer | 2.0 |
| Sodium xylene sulphonate | 2.0 |
| Oleic acid | 2.0 |
| Tallow fatty acids | 1.0 |

-continued

| | % |
|---|---|
| Potassium hydroxide | 2.28 |
| Water and miscellaneous | 56.72 |
| | 100.00 |

All the bags except that of Example 7 had opened by rupture of the polyethylene/nonwoven fabric bond. The bag of Example 7, which had been heat-sealed from both sides at the relatively high temperature of 180° C., had opened by separation of the laminated nonwoven fabric strip itself into layers, the polyethylene/nonwoven fabric bonds remaining intact.

TABLE

| Example | Type of insert material | Trade name and manufacturer (* denotes Trade Mark) | Base weight of material ($g/m^2$) | Temperature of heat seal (±5° C.) | Heat-sealed from one or both sides |
|---|---|---|---|---|---|
| 3 | Nonwoven fabric: Manila hemp fibres, bonded with viscose for wet-strength | "Springtex* 21" (J R Crompton Bros. Ltd) | 21 | 130° C. | Both |
| 4 | Nonwoven fabric: Manila hemp fibres, bonded with viscose for wet-strength | "Springtex* 21" (J R Crompton Bros. Ltd) | " | 150° C. | One |
| 5 | Wet-strength paper: Softwood pulp, crosslinked with cationic polymer | "Gessner Duftex* 3" (Gessner & Co GmbH) | 50 | 180° C. | One |
| 6 | Nonwoven fabric: 40% cotton linters, 55% viscose, 5% polyamide | "Storalene* 610:60" (Stora-Kopparberg) | 60 | 130° C. | Both |
| 7 | Nonwoven fabric: 40% cotton linters, 55% viscose, 5% polyamide | "Storalene* 610:60" (Stora-Kopparberg) | " | 180° C. | Both |
| 8 | Nonwoven fabric: 50% viscose 50% nylon | "BFF T45" (Bonded Fibre Fabrics Ltd) | 45 | 130° C. | One |
| 9 | Nonwoven fabric: 100% nylon | "Lantor"* (Lantor Ltd) | 43 | 130° C. | Both |
| 10 | Nonwoven fabric: 100% polyester | "Reemay* 2066" (E I Du Pont de Nemours Inc) | 21 | 130° C. | One |

The bag opened in less than two minutes from the beginning of the wash cycle and good detergency results were obtained.

EXAMPLES 3 to 10

Eight bags were formed from polyethylene film having a basis weight of 47 $g/m^2$. Each bag was rectangular in shape, approximately 9 cm×11 cm, and was heat-sealed along three edges. Each bag was filled with 150 g of the liquid detergent composition of Example 1. A strip of nonwoven fabric or paper approximately 1 cm wide was inserted along the fourth edge between the two sheets of polyethylene and the two sheets were then heat-sealed to the strip between them, either from one side only or from both sides. The materials used for the strip and details of the heat-sealing method used are given in the Table below.

To test the performance of the various seals, each bag was placed in the drum of a Lavamat Regina SL front-loading automatic washing machine together with a 4 lb load of clean terry towelling and cotton sheeting. After 5 minutes of the wash cycle had been completed, the machine was stopped, the bag removed and the state of the seal examined. All eight bags had opened and the majority of their contents had been discharged.

We claim:

1. In a fabric treatment product for washing machine use in the form of a bag containing a fabric treatment composition, the improvement which comprises a bag formed of water-insoluble water-impermeable synthetic thermoplastic sheet material, said bag containing a fabric treatment composition comprising a liquid, said bag being closed by at least one weak heat seal formed by two opposed bag walls heat-sealed to a separator sheet inter-positioned between them, said separator sheet being of porous material which is not thermoplastic at the heat-sealing temperature used, whereby said weak heat seal will self-open when in use and agitated in a washing machine.

2. The product of claim 1, wherein the separator sheet is of fibrous material selected from the group consisting of papers and nonwoven fabrics.

3. The product of claim 1, wherein the fabric treatment composition is selected from the group consisting of fully formulated fabric washing compositions, bleaches, bleach precursors, fabric softeners, enzymes, starch, perfumes, antibacterial agents, antistatic agents, whitening agents, blueing agents, stain-removing agents and mixtures thereof.

* * * * *